US008471665B2

(12) United States Patent
Urano

(10) Patent No.: US 8,471,665 B2
(45) Date of Patent: Jun. 25, 2013

(54) MAGNETIC ELEMENT

(75) Inventor: Yuichiro Urano, Chuo-ku (JP)

(73) Assignee: Sumida Corporation (JP)

( * ) Notice: Subject to any disclaimer, the term of this patent is extended or adjusted under 35 U.S.C. 154(b) by 0 days.

(21) Appl. No.: 13/450,824

(22) Filed: Apr. 19, 2012

(65) Prior Publication Data

US 2013/0027161 A1 Jan. 31, 2013

(30) Foreign Application Priority Data

Jul. 25, 2011 (JP) ..... 2011-004307 U

(51) Int. Cl.
*H01F 27/29* (2006.01)
*H01F 27/02* (2006.01)
*H01F 27/24* (2006.01)

(52) U.S. Cl.
USPC ..... 336/192; 336/83; 336/212

(58) Field of Classification Search
USPC ..... 336/192, 83, 212, 221, 178
See application file for complete search history.

(56) References Cited

U.S. PATENT DOCUMENTS

| | | | | |
|---|---|---|---|---|
| 6,292,083 | B1 * | 9/2001 | Tajima et al. | 336/192 |
| 6,914,506 | B2 * | 7/2005 | Gallup et al. | 336/83 |
| 7,411,478 | B2 * | 8/2008 | Hatakeyama et al. | 336/192 |
| 7,940,153 | B2 * | 5/2011 | Watanabe | 336/192 |
| 8,072,303 | B2 * | 12/2011 | Oki | 336/192 |
| 2003/0179062 | A1 * | 9/2003 | Kuwata et al. | 336/83 |
| 2005/0017835 | A1 * | 1/2005 | Oki | 336/65 |
| 2012/0105190 | A1 * | 5/2012 | Mitani et al. | 336/221 |

FOREIGN PATENT DOCUMENTS

JP 2010-205783 6/2003

* cited by examiner

*Primary Examiner* — Mohamad Musleh
*Assistant Examiner* — Mangtin Lian
(74) *Attorney, Agent, or Firm* — Harness, Dickey & Pierce, P.L.C.

(57) ABSTRACT

A magnetic element including: a first magnetic core including a coil which is wound by a predetermined number of turns; a second magnetic core which includes the coil in the inside thereof and which is combined along the outer circumference of the first magnetic core; and a metal terminal which connects the coil and a mounting substrate, wherein the metal terminal includes a fixing portion for fixing the second magnetic core in a state of combining the first magnetic core and the second magnetic core.

5 Claims, 6 Drawing Sheets

MAGNETIC ELEMENT

CROSS-REFERENCE TO RELATED APPLICATION

This application claims priority to Japanese Utility Model Application No. JP U2011-4307 filed Jul. 25, 2011 which is hereby expressly incorporated by reference herein in its entirety.

BACKGROUND

1. Field of the Invention

The present invention relates to a magnetic element which is mounted on an electronic circuit and makes it possible to maintain its performance even in such a circumstance vibration is added continuously.

2. Description of the Related Art

From the past, there has been used a magnetic element which is mounted on an electronic circuit installed in an automobile or the like and which adjusts impedance or the like. In a Patent Document 1 (Japanese unexamined patent publication No. 2010-205783), there is disclosed a general constitution relating to a magnetic element in the past. This magnetic element is provided with a coil, a ferrite drum core housing the coil in the inside thereof, a ring core housing the drum core, and a metal terminal. Both ends of the coil are passed through a gap or a hole portion between the ring core and the drum core and are connected to the metal terminal.

SUMMARY

However, there is a case in which the magnetic element in the past is mounted on a mounting substrate provided for an electronic circuit of a machine (for example, automobile) to which violent vibration is added. In this case, although the mounting substrate is connected with a mounting face of the metal terminal, a connecting portion between the mounting face and the metal terminal is easily destroyed by addition of continuous vibration to the mounting face. Consequently, there sometimes happened such a case in which a breakdown of the machine was caused by detachment of the magnetic element from the mounting substrate, deviation of the positions of the drum core and the ring core, or the like.

The present invention was invented in view of such a situation and is addressed to prevent destruction of a magnetic element mounted on a mounting substrate even under a circumstance in which vibration is added thereto.

A magnetic element relating to the present invention is provided with a first magnetic core including a coil which is wound by a predetermined number of turns, a second magnetic core which includes the coil in the inside thereof and which is combined along the outer circumference of aforesaid first magnetic core, and a metal terminal which connects the coil and a mounting substrate. Then, the metal terminal is constituted by a fixing portion for fixing the second magnetic core while combined in a state of combining the first magnetic core and the second magnetic core.

According to the present invention, the metal terminal fixes the first magnetic core and the second magnetic core, so that the vibration-proof properties of the whole magnetic element are improved and the magnetic element will not easily be destroyed.

DESCRIPTION OF EXEMPLARY EMBODIMENTS

1. First Exemplified Embodiment

Hereinafter, it will be explained with respect to a first exemplified embodiment (hereinafter, referred to as "this embodiment") of the present invention with reference to FIG. 1 to FIG. 5. In this exemplified embodiment, it will be explained with respect to an example in which the present invention is applied to a magnetic element 1 mounted on a mounting substrate which is not shown and which is provided on an electronic circuit of an automobile or the like to which vibration is added continuously.

Figure 1A:
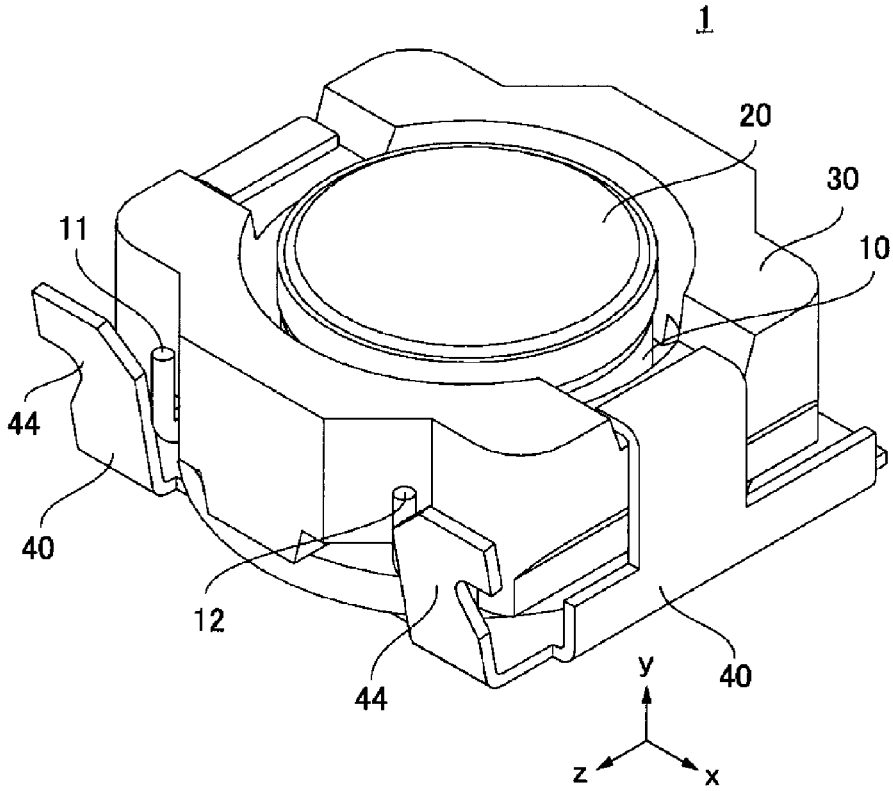
FIGS. 1A and 1B are perspective views of a magnetic element in a first exemplified embodiment of the present invention.
Figure 1B:
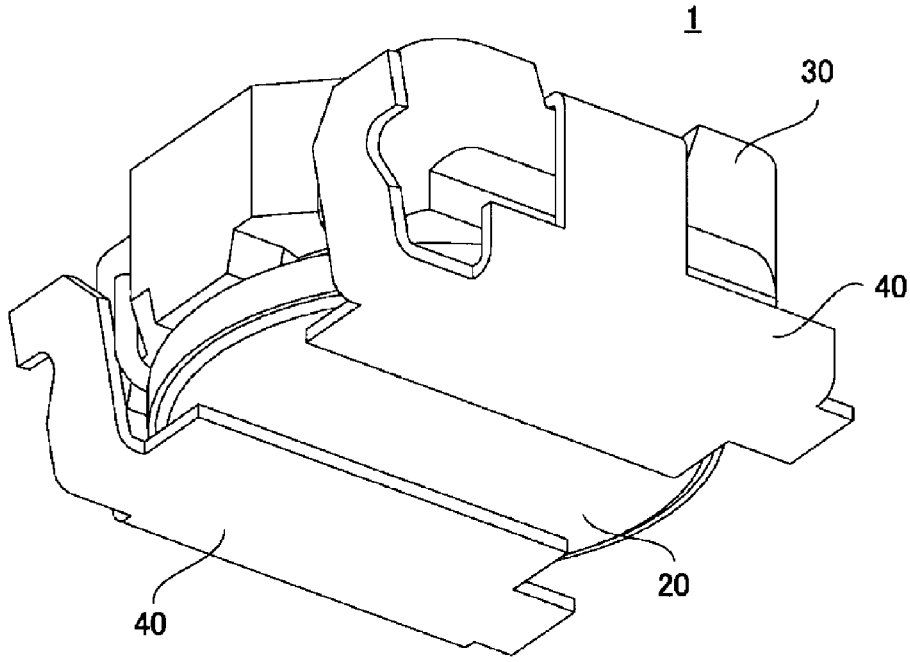

FIG. 1 is an outward-appearance perspective view showing a constitution example of the magnetic element 1 of this embodiment. FIG. 1A shows an example in which the magnetic element 1 is seen with respect to the upper surface thereof and FIG. 1B shows an example in which the magnetic element 1 is seen with respect to the bottom surface thereof.

The magnetic element 1 is provided with a first magnetic core 20, a coil 10 whose conductive wire is wound by a predetermined number of turns around a winding axis 23 (see FIG. 2 mentioned later) of the first magnetic core 20, a second magnetic core 30 which includes the coil 10 in the inside thereof and which is combined with the first magnetic core 20, and a metal terminal 40 which is formed with respect to the second magnetic core 30. The metal terminal 40 is divided into plane-symmetric shapes, terminal ends 11, 12 of the coil 10 are wound around at binding portions 44 of the respective terminals, and the terminal ends 11, 12 are bonded to the metal terminal by solder which is not shown.

Figure 2:
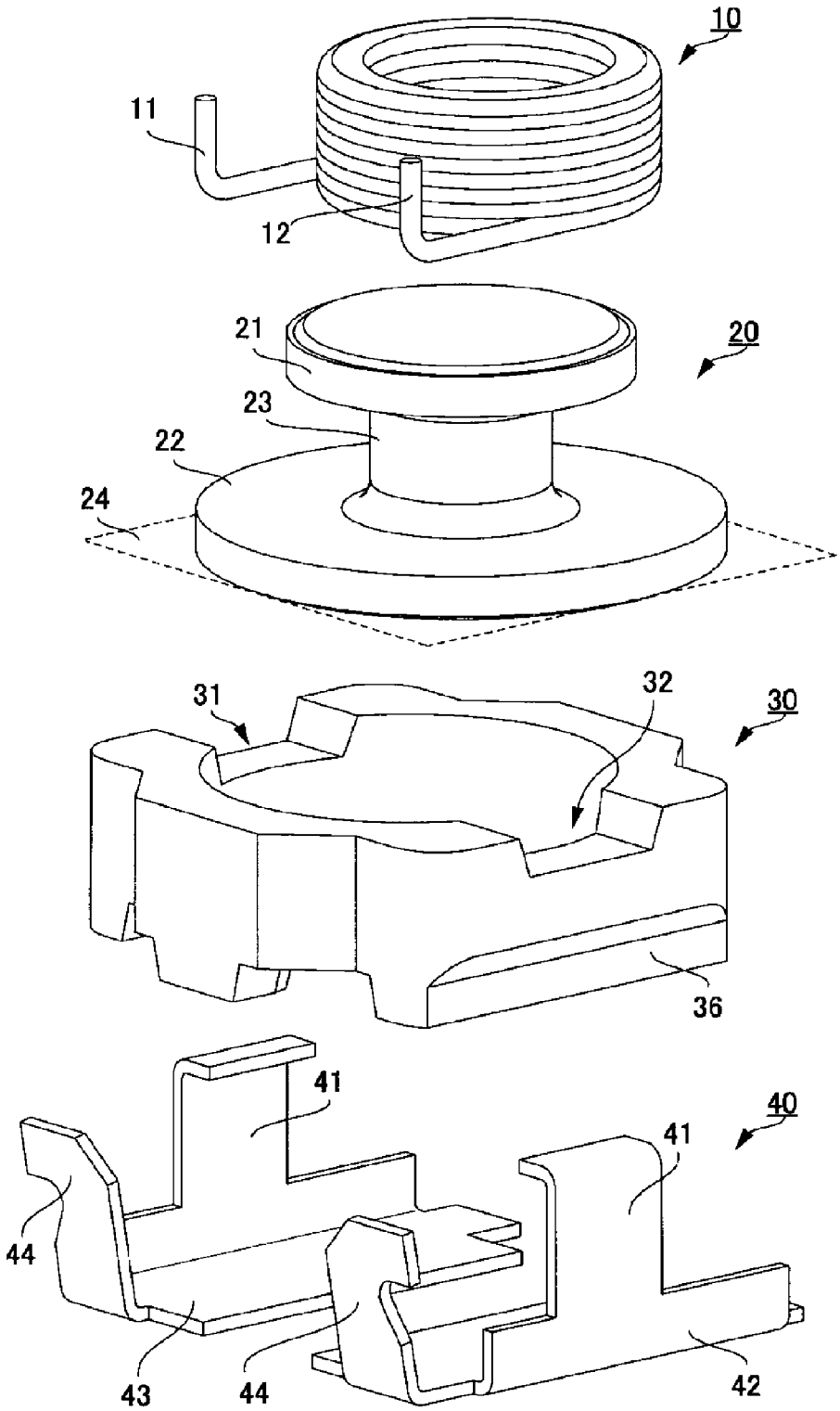
FIG. 2 is an exploded perspective view of the magnetic element in the first exemplified embodiment of the present invention.

FIG. 2 is an exploded perspective view of the magnetic element 1.

The coil 10 has terminal ends 11, 12 at both ends thereof and the coil is wound around the winding axis 23 of the first magnetic core 20.

The first magnetic core 20 is formed as a drum core including a winding axis 23 around which the coil 10 is wound, and a small flange portion 21 and a large flange portion 22 which are provided at both ends of the winding axis 23 respectively and whose diameters are unequal to each other. The small flange portion 21 is larger than the winding axis 23 in radius and the large flange portion 22 is larger than the small flange portion 21 in radius.

The second magnetic core 30 is formed as a ring core having a ring shape surrounding the first magnetic core 20 and is combined with the large flange portion 22 in a state in which a winding axis 23 included in the first magnetic core 20 is inserted therein. Then, for the substantially four sides of the bottom surface of the second magnetic core 30, there are formed circumferential walls which are perpendicular to the bottom surface thereof and at the end portions on the upper surface side of the circumferential walls which are formed on a pair of opposing two sides, there are formed a first cutaway portion 31 and a second cutaway portion 32.

The diameter of the large flange portion 22 of the first magnetic core 20 is formed to be larger than that of the small flange portion 21 and by placing a portion of the lower surfaces of the circumferential walls of the second magnetic core over the upper surface of the large flange portion 22, the first magnetic core 20 and the second magnetic core 30 are assembled so as to form a single closed magnetic path. It should be noted that this closed magnetic path is constituted as a discontinuous magnetic path due to the existence of a coated non-magnetic material or an air gap between the first magnetic core 20 and the second magnetic core 30. It should be noted that caused by the discontinuous magnetic path, it is difficult for the first magnetic core 20 and the second magnetic core 30 to undergo magnetic saturation and it is possible to improve the direct-current superimposing characteristic of the whole magnetic element 1.

Also, the first magnetic core 20 and the second magnetic core 30 are manufactured generally by a Mn—Zn based or Ni—Zn based ferrite material. However, not limited by these ferrite materials, it is also possible to use magnetic materials such as permalloy, sendust and the like.

Then, the metal terminal 40 is provided with a fixing portion 41, a solder fillet forming portion 42, a mount portion 43 and a binding portion 44. The metal terminal in the past was formed in a flat shape and had a large mounting face and therefore, it was considered that connection strength of the metal terminal with respect to the mounting substrate was high. However, the mounting face formed in a plate shape deformed easily and a gap was easily formed between the deformed mounting face and each component. When such a gap was formed, it sometimes happened that the connection strength of each component between the metal terminal and the drum core, between the metal terminal and the mounting substrate or the like is weakened.

Also, the drum core and the ring core were bonded and fixed only by an adhesive agent applied between both sides, so that when a large vibration was added, it also sometimes happened that the ring core detached from the drum core.

In order to prevent the ring core from dropping off from the drum core, there is formed, at the front end of the fixing portion 41 provided for the metal terminal 40, a claw in an inwardly bent manner for being hooked to a first cutaway portion or a second cutaway portion 32. Then, the mount portion 43 connected to the mounting substrate is bonded to the large flange portion 22 of the first magnetic core 20 and the fixing portion 41 of the metal terminal 40 is formed up to the height of the first cutaway portion 31 or the second cutaway portion 32 which is formed on the second magnetic core 30. Then, the fixing portion 41 fixes the second magnetic core 30 in a state in which the first magnetic core 20 and the second magnetic core 30 are combined. Also, in order to prevent the metal terminal 40 from deforming, the solder fillet forming portion 42 is formed along the outer walls of the first magnetic core 20 and the second magnetic core 30. The solder fillet forming portion 42 is used also for inducing formation of the solder fillet with respect to the mounting substrate when the magnetic element 1 is soldered and fixed to the mounting substrate.

Figure 3A:
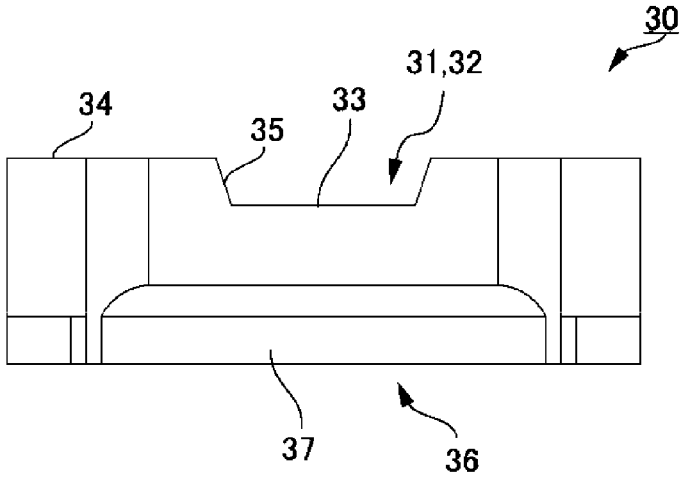
FIGS. 3A and 3B are respectively a side view and a perspective view of a second magnetic core in the first exemplified embodiment of the present invention.
Figure 3B:
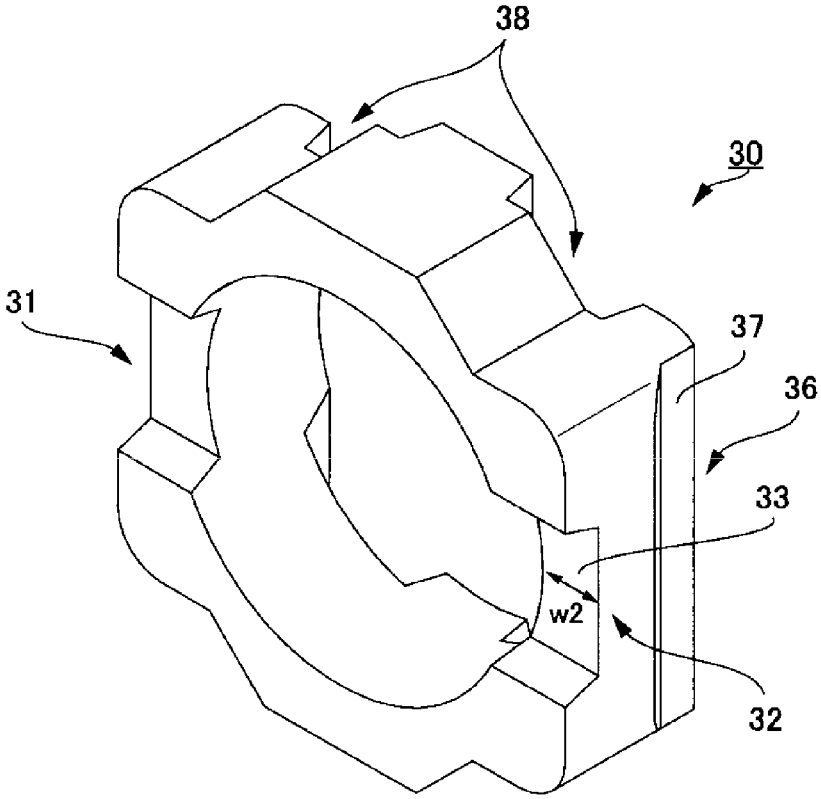

FIG. 3 are a side view and a perspective view of the second magnetic core 30. FIG. 3A is a side view of the second magnetic core 30, and FIG. 3B is a perspective view of the second magnetic core 30.

Figure 4:
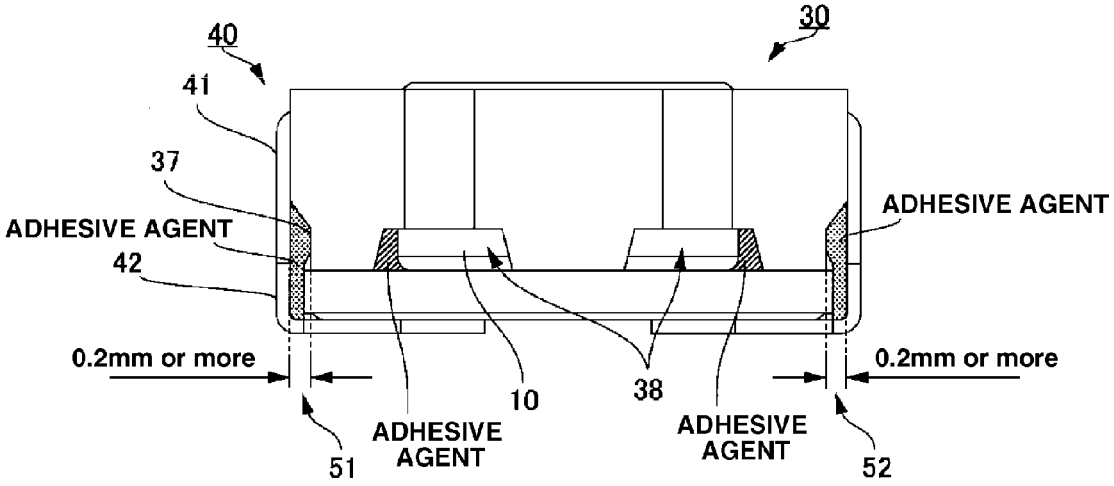
FIG. 4 is a constitution diagram in case of seeing the magnetic element in the first exemplified embodiment of the present invention from the side thereof.

FIG. 4 is a constitution diagram in case of seeing the magnetic element 1 from a side thereof.

As mentioned above, on the opposing circumferential walls of the second magnetic core 30, there are formed the first cutaway portion 31 and the second cutaway portion 32 having inverted trapezoidal shapes from the upper surfaces of the circumferential walls toward the mounting face. The bottom surfaces 33 of the first cutaway portion 31 and the second cutaway portion 32 are flat and made approximately parallel with the plane surface of the mount portion 43, and there are formed inclination surfaces 35 between the bottom surface 33 and the upper surface 34 of the circumferential wall of the second magnetic core 30.

Also, immediately under the circumferential wall on which the first cutaway portion 31 and the second cutaway portion 32 of the second magnetic core 30 are formed, there is formed a concave portion 36 toward the center of the second magnetic core 30. Also, the side surface 37 of the concave portion 36 lies in approximately the same position as that of each side of a square (see FIG. 2) which circumscribes the large flange portion 22 when the first magnetic core 20 is combined with the second magnetic core 30. Thus, there exists an air gap 51 as shown in FIG. 4 between the outer edge of the concave portion 36 & the large flange portion 22 and the solder fillet forming portion 42 of the metal terminal 40. Similarly, on the opposing circumferential walls of the second magnetic core 30, there are formed the concave portion 36 and the same side surface 37 immediately under the cutaway portion 32, and an air gap 52 is also made between the outer edge of the side surface 37 & the large flange portion 22 and the metal terminal 40. It is preferable for the width from the side surface 37 of the second magnetic core 30 to the inner surface of the solder fillet forming portion 42 to be 0.2 mm or more.

The air gap 51 also has an effect of restraining an adhesive agent injected between the metal terminal 40 and the first magnetic core 20 from overflowing to the outer circumference of the magnetic element 1. Consequently, in a process in which the first magnetic core 20 and the second magnetic core 30 are bonded to each other by an adhesive agent, an excessive adhesive agent which has overflowed from the coating portion of the adhesive agent will flow into the air gap 51. When the adhesive agent flows into the air gap 51, it becomes a situation in which the excessive adhesive agent does not flow out to the outside of the second magnetic core 30. Thus, there is an effect of suppressing occurrences of defects such as an occurrence of a connection defect of the metal terminal 40 caused by the excessive adhesive agent, an occurrence of a bonding defect caused between the first magnetic core 20 and the second magnetic core 30 by the excessive adhesive agent, and the like.

At the four corners of the bottom surface of the second magnetic core 30, there are provided four cutaway portions 38 along the lower surface of the second magnetic core 30 in order to pull out the terminal ends 11, 12 of the coil 10. By way of these cutaway portions 38, the terminal ends 11, 12 of the coil 10 are pulled out freely from the second magnetic core 30. Then, by pulling out the terminal ends 11, 12 from the cutaway portion selected from the four cutaway portions 38 based on the specification required for the magnetic element 1, it is possible to adjust the number of turns of the conductive wire wound for the coil 10 by an amount of ¼, ½ or ¾ turns.

Figure 5A:
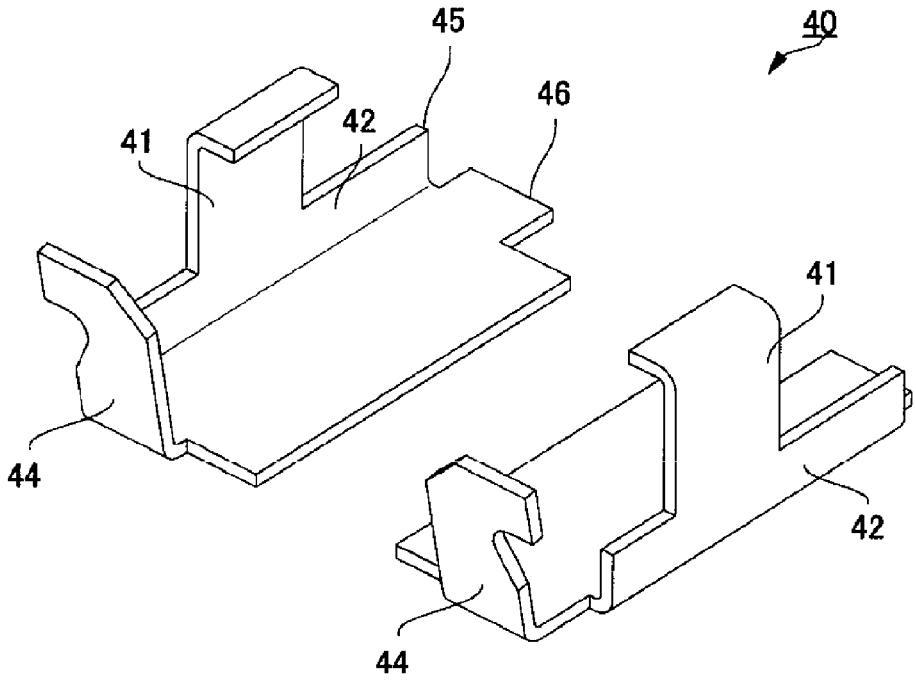
FIGS. 5A and 5B are perspective views of a metal terminal in the first exemplified embodiment of the present invention.
Figure 5B:
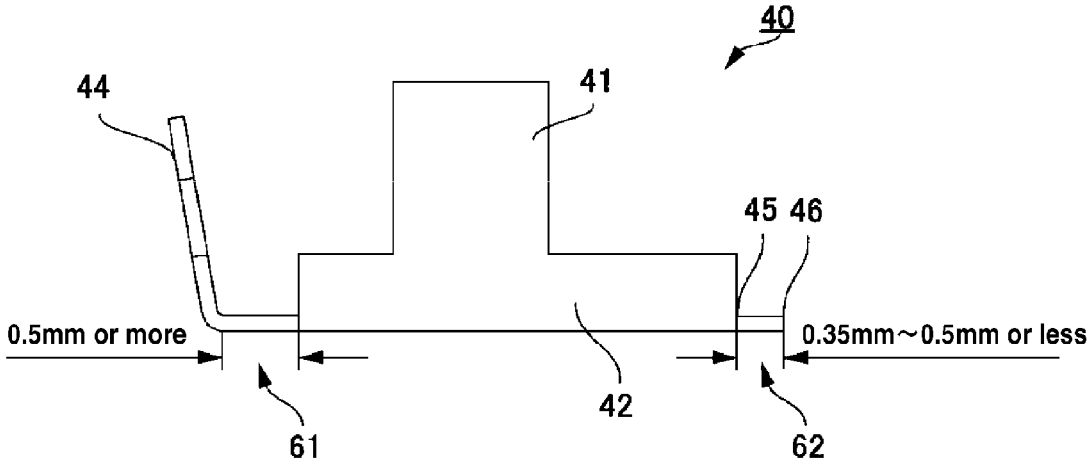

FIG. 5 are a perspective view and a side view of the metal terminal 40. FIG. 5A is a perspective view of the metal terminal 40. FIG. 5B is a side view of the metal terminal 40.

The metal terminal 40 is provided with a fixing portion 41 for fixing the second magnetic core 30, a solder fillet forming portion 42 which heightens the bonding strength on an occasion when mounting the magnetic element 1 on the mounting substrate, a mount portion 43 which is connected to the mounting face, and a binding portion 44 which binds the terminal end 11, 12 of the coil 10. The metal terminal 40 plays a combined role in serving both as a binding terminal for binding the terminal ends 11, 12 of the coil 10 and as a user terminal.

The fixing portions 41 are extended from the upper end surfaces of the solder fillet forming portions 42 to the bottom surfaces of the first cutaway portion 31 and the second cutaway portion 32 along the outer circumferential surface which lies on the outermost side of the second magnetic core 30. The front ends of the fixing portions 41 are bent inward in hook shapes and hooked to the first cutaway portion 31 and the second cutaway portion 32 of the second magnetic core 30 combined with the first magnetic core 20, and fix the first magnetic core 20 and the second magnetic core 30 to each other while maintaining the position at the time of the combination of the second magnetic core 30 with respect to the first magnetic core 20. The solder fillet forming portion 42 and the mount portion 43 fix the whole magnetic element 1 on the mounting substrate. Thus, the first magnetic core 20 and the second magnetic core 30 are integrated and it is possible to withstand the violent vibration added from the mounting substrate.

The solder fillet forming portion 42 is provided for inducing formation of the solder fillet between the mounting substrate and the metal terminal 40. The solder fillet forming portion 42 is formed from the circumferential wall of the large flange portion 22 and the end surface of the side surface 37, through the air gaps 51 and 52, along the wall surface which lies at the outermost circumference of the second magnetic core 30, perpendicularly to the mounting face from the edge side of the mount portion 43, and in a manner that is bent toward the inside.

When the installation area between the solder fillet forming portion 42 and the mounting substrate increases, the mounting face coated with solder cream becomes large and the bonding strength between the metal terminal 40 and the mounting substrate heightens. As a result, the magnetic element 1 does not easily drop off from the mounting substrate. Also, the solder fillet forming portion 42 is formed by applying a bending process to a portion of the metal terminal 40 and the process is easy and concurrently, the area of the solder fillet forming portion 42 can be increased arbitrarily. Consequently, it can be expected that vibration-proof properties of the whole magnetic element 1 improve.

Also, owing to the solder fillet forming portion 42, in a case in which the magnetic element 1 is installed on the mounting substrate, it never happens that the element is fixed only by the solder cream applied between the mount portion 43 and the mounting substrate. In other words, the solder fillet is formed between the outside of the solder fillet forming portion 42 and the mounting substrate, so that the connection strength when the metal terminal 40 is mounted on the mounting substrate becomes even higher. Further, the larger the width of the solder fillet forming portion 42 is, the larger the soldering area to the mounting substrate when the solder fillet is formed is, and the bonding strength also becomes high, and concurrently, deformation of the metal terminal 40 is also suppressed. Consequently, the width of the solder fillet forming portion 42 is selected to be at least larger than that of the fixing portion 41.

In order to enlarge the width of the solder fillet forming portion 42, the distance between terminal end 45 of the solder fillet forming portion 42 and the cut surface 46 is formed to be 0.5 mm or less. It is, further, preferable for this distance to be 0.35 mm or less. Also, in order to suppress the influence of the positional deviation of the metal terminal 40 with respect to the first magnetic core 20, it is desirable to employ such a design in which the adhesive agent having flowed out from the second magnetic core 30 gets over the upper end of the solder fillet forming portion 42 and escapes to the outside.

Also, when treating the binding portion 44 with soldering, there exist air gaps 61, 62 by which the solder does not come into contact with the solder fillet forming portion 42 (see FIG. 5B). These air gaps 61, 62 exist between the root of the binding portion 44 and a front end of the root of the solder fillet forming portion 42 and exist in order to house the adhesive agent which has overflowed from between the first magnetic core 20 and the second magnetic core 30 and between the second magnetic core 30 and the metal terminal 40, and in order to prevent wire disconnection of the terminal ends 11, 12 which are wound around the binding portion 44. It is desirable for the width of this air gap 61 to be 0.5 mm or more.

The mount portion 43 is formed in a plate shape on a plane surface approximately perpendicular to the axial direction of the winding axis 23, and the lower surface thereof is connected to the mounting substrate by being coated with a conductive adhesive material such as solder cream or the like. Also, the upper surface of the mount portion 43 is bonded to the lower surface of the large flange portion 22 by being coated with an insulative adhesive agent such as resin or the like.

In this manner, by disposing the second magnetic core 30 on the large flange portion 22 of the first magnetic core 20, the whole coil set including the first magnetic core 20 and the second magnetic core 30 is integrated. Also, the metal terminal 40 can fix the first magnetic core 20 and the second magnetic core 30. Consequently, the vibration-proof properties of the whole magnetic element 1 are improved and concurrently, the mutual connection strength among the first magnetic core 20, the second magnetic core 30 and the metal terminal 40 becomes high.

Next, it will be explained with respect to a manufacturing process of the magnetic element 1.

First, the first magnetic core 20 around which the conductive wire is wound and the second magnetic core 30 are combined and bonded. Next, the combined first magnetic core 20 and second magnetic core 30 are bonded to the metal terminals 40.

Thereafter, the terminal ends 11, 12 of the coil 10 are bound to the binding portions 44 so as to face outward with respect to each other. Then, the binding portions 44 with the terminal ends 11, 12 bound thereto is subjected to solder bonding and the magnetic element 1 is manufactured.

According to the magnetic element 1 relating to the first exemplified embodiment explained above, the first magnetic core 20 and the second magnetic core 30 are combined and thereafter, the second magnetic core 30 is bonded to the metal terminal 40 and further, by fixing the second magnetic core 30 onto the metal terminal 40 by means of the fixing portion 41, it is possible to firmly fix respective components constituting the magnetic element 1. Consequently, even if mechanical vibration is added to the magnetic element 1 mounted on the mounting substrate, the magnetic element 1 does not easily decompose. Also, the bent front end of the fixing portion 41 of the metal terminal 40 is fitted with the cutaway portion 31, 32 formed on the second magnetic core 30 beforehand and these are bonded by an adhesive agent, so that the fixing strength is heightened even further.

Also, due to the existence of the air gaps 51, 52 between the side surface 37 of the second magnetic core 30 and the solder fillet forming portion 42, an excessive adhesive agent within the adhesive agent injected into the first magnetic core 20 will flow into the air gaps 51, 52. Consequently, it is possible to prevent the adhesive agent from flowing out to the outside of the magnetic element 1.

Also, on the second magnetic core 30, there are formed four cutaway portions 38 and the terminal ends 11, 12 of the coil are pulled out from these cutaway portions 38. Consequently, the number of turns of the coil 10 is adjustable by an amount of ¼, ½ and ¾ turns, and it becomes easy for the number of turns of the coil 10 to suit the use application of the magnetic element 1.

Also, by providing the solder fillet forming portion 42 at the metal terminal 40, it becomes difficult for the mount portion 43 to bend in the direction perpendicular to the bending direction of the solder fillet forming portion 42. Also, the mount portion 43 has a wide area, so that the area in contact with the mounting substrate becomes large. Also, owing to the solder fillet forming portion 42, the solder fillet can be formed easily when connecting the metal terminal to the mounting substrate and the connection strength with respect to the mounting substrate increases even further. Also, the metal terminals 40 are constituted by symmetrical two components and by being provided apart from each other, they are insulated sufficiently and a short circuit therebetween is prevented.

2. Second Exemplified Embodiment

Next, it will be explained with respect to a constitution of a magnetic element 70 relating to a second exemplified embodiment of the present invention. In this exemplified embodiment, the coil 10 is used as an air-core coil.

Figure 6:
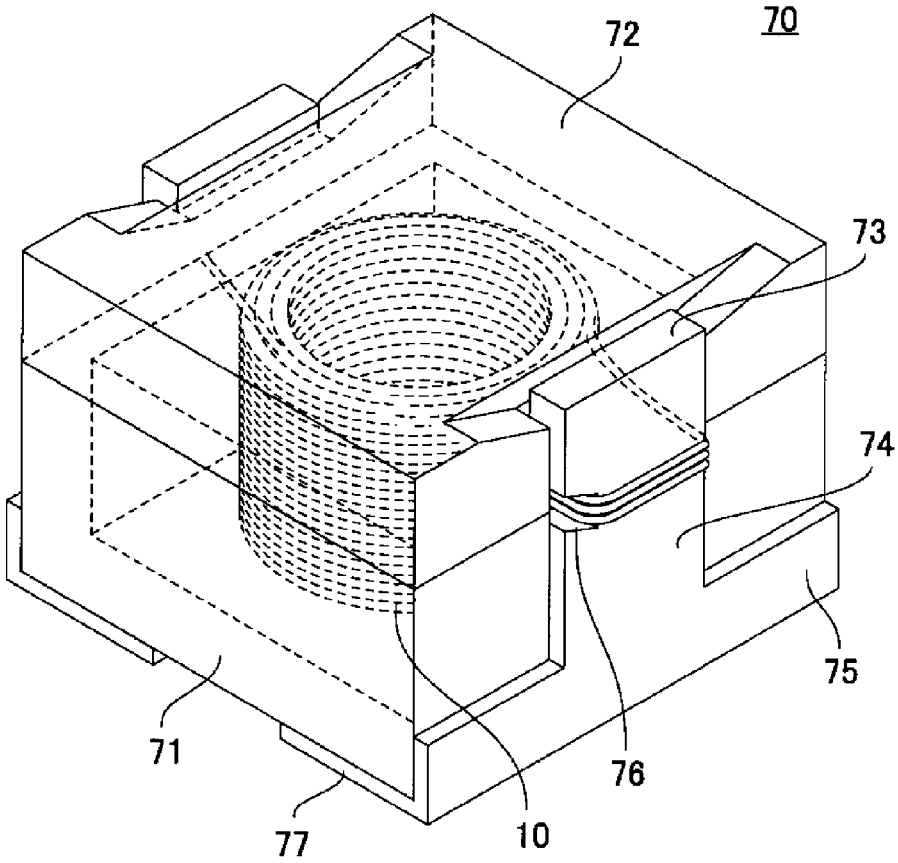
FIG. 6 is a perspective view of a magnetic element in a second exemplified embodiment of the present invention.

FIG. 6 is a perspective view showing a constitution example of the magnetic element 70.

The magnetic element 70 is constituted by the coil 10, a box shaped first magnetic core 71 whose one surface is opened, a plate shaped second magnetic core 72 which is fitted to the opened one surface of the first magnetic core 71, and metal terminals 74. Also, with respect to the magnetic element 70, the metal terminal is provided with a fixing portion 73 for fixing the second magnetic core 72, a solder fillet forming portion 75 which heightens the bonding strength when the magnetic element 70 is bonded onto a mounting substrate, and a mount portion 77 connected to the mounting substrate. Then, terminal ends extended from the coil which is housed in the first magnetic core 71 are bound to the metal terminals 74 formed with binding portions which fix both ends of the coil 10.

Here, the portion corresponding to the binding portion 44 relating to the first exemplified embodiment mentioned above is formed integrally with the fixing portion 73. More specifically, a concave portion 76 for binding the terminal end of the coil is formed at the fixing portion 73. Owing to this constitution, the first magnetic core 71 and the second magnetic core 72 are integrated and withstand violent vibration. Also, owing to the solder fillet forming portion 75, the solder fillet area increases, so that there can be expected such an effect that also the connection strength between the magnetic element 70 and the mounting substrate becomes high.

Also, the present invention is not to be limited by the exemplified embodiment mentioned above and it is needless to say that other various application examples or modification examples can be employed without departing from the gist of the present inventions described in the appended claims.

Having described preferred embodiments of the invention with reference to the accompanying drawings, it is to be understood that the invention is not limited by those precise embodiments and that various changes and modifications could be effected therein by one skilled in the art without departing from the spirit or scope of the invention as defined in the appended claims.

What is claimed is:

1. A magnetic element comprising:

a first magnetic core including a coil which is wound by a predetermined number of turns;

a second magnetic core which circumferentially surrounds said first magnetic core and which is combined with said first magnetic core, said second magnetic core having a cutaway portion; and a metal terminal which connects said coil and a mounting substrate, wherein said metal terminal includes:

a fixing portion which secures said second magnetic core to said first magnetic core;

a mount portion which is connectable to said mounting substrate, said mount portion having first and second sides;

a solder fillet forming portion extending from said first side of said mount portion along an outer wall of said second magnetic core; and a binding portion to which an end of said coil is bound, said binding portion extending from said second side of said mount portion along said outer wall of said second magnetic core, wherein a first air gap of 0.5 mm or more is located between a root of said binding portion and a root of said solder fillet forming portion;

a concave portion is formed on said outer wall of said second magnetic core immediately under said cutaway portion toward a center of said second magnetic core, and said concave portion is located next to said solder fillet forming portion.

2. The magnetic element according to claim 1, wherein said first magnetic core includes a winding axis around which said coil is wound, and a first flange portion and a second flange portion which are provided at both ends of said winding axis respectively and whose diameters are unequal to each other;

said second magnetic core is formed in a ring shape surrounding said first magnetic core and is disposed at said first flange portion in a state in which said winding axis is inside said second magnetic core, and said cutaway portion is adjacent to said second flange portion; and said mount portion of said metal terminal is bonded to said first flange portion of said first magnetic core and said fixing portion of said metal terminal engages said cutaway portion of said second magnetic core.

3. The magnetic element according to claim 1, wherein a tip of said fixing portion is hooked to a cutaway portion of said second magnetic core and said fixing portion maintains relative positioning when said second magnetic core is combined with said first magnetic core.

4. The magnetic element according to claim 1, wherein a second air gap is formed between the concave portion of said second magnetic core and said solder fillet forming portion, and a third gap is formed between an outer edge of said first flange portion and said solder fillet form portion.

5. A magnetic element, comprising:

an air-core coil;

a first magnetic core having a box shape with an open top, the air-core coil being provided inside the first magnetic core;

a second magnetic core fit within the open top of the first magnetic core; and a metal terminal connected to the air-core coil, the metal terminal including:

a mount portion under the first magnetic core relative to the second magnetic core;

a solder fillet forming portion having a first plate shape of a first width and that perpendicularly extends from the mount portion along a side of the first magnetic core;

a fixing portion having a second plate shape of a second width that is narrower than the first width, and that extends from the solder fillet forming portion further along the side of the first magnetic core, the fixing portion having a tip that engages a cutaway of the second magnetic core to secure the second magnetic core to the first magnetic core, and a binding portion to which an end of the air-core coil is attached, the binding portion having a recess between the tip and the solder fillet forming portion for binding the end of the air-coil.

* * * * *